United States Patent [19]

Syrjanen

[11] 4,009,835

[45] Mar. 1, 1977

[54] PROCEDURE AND APPARATUS FOR PREPARATION OF HOT GROUNDWOOD

[75] Inventor: Ahti Syrjanen, Valkeakoski, Finland

[73] Assignee: Yhtyneet Paperitehtaat Oy Jylhavaara, Valkeakoski, Finland

[22] Filed: July 29, 1975

[21] Appl. No.: 600,093

[30] Foreign Application Priority Data

Apr. 4, 1975 Finland ..... 751016

[52] U.S. Cl. ..... 241/28

[51] Int. Cl.[2] ..... B02C 7/02

[58] Field of Search ..... 241/23, 28, 65, 245, 241/246, 247

[56] References Cited

UNITED STATES PATENTS

| | | | |
|---|---|---|---|
| 2,008,892 | 7/1935 | Asplund | 241/28 |
| 3,661,328 | 5/1972 | Leask | 241/28 |
| 3,765,611 | 10/1973 | Steiniger | 241/23 |
| 3,847,363 | 11/1974 | Reinhall | 241/245 |
| 3,910,505 | 10/1975 | Reinhall | 241/28 |
| 3,921,918 | 11/1975 | Peterson | 241/28 |

*Primary Examiner*—Granville Y. Custer, Jr.
*Attorney, Agent, or Firm*—Haseltine, Lake & Waters

[57] ABSTRACT

Continuously operating procedure for preparing hot groundwood from wood chips, wherein the chip flow is conducted into a pressurized steaming chamber, where the chips reside a few minutes and are heated to a temperature in excess of 100° C, and from the steaming chamber to a sealing feeder, the rotor of which is circumferentially divided into mutually adjacent compartments, each of which in its turn fills through a feeding aperture with chips and empties in another angular position of the rotor through a discharge opening into a feeding conveyor, which carries the chips to a hot grinder, the groundwood derived from the latter being carried to further treatments, whereat the steam generated by the hot grinder and discharging from its throat in the direction against the chip flow is conducted away from the grinder. The steam is conducted through the feeding conveyor to the sealing feeder, where each compartment, as it is emptied of chips in its turn, fills with steam. The steam is drained from the sealing feeder through a steam draining aperture located in the direction of rotation of the rotor before the feeding aperture.

1 Claim, 4 Drawing Figures

PROCEDURE AND APPARATUS FOR PREPARATION OF HOT GROUNDWOOD

Hot groundwood is produced from wood chips in a continuous process in principle in that the chips are first introduced into a steaming chamber, where they are heated to a temperature in excess of 100° C, preferably between 120° and 135° C. From the steaming chamber the chip flow is directed through a sealing feeder to a hot grinder, at which stage the chips have a dry matter content about 20 to 30%. The hot groundwood derived from the grinder is conducted to further treatment.

This procedure of preparing hot groundwood offers a number of remarkable advantages. The heating of the chips prior to grinding promotes the detachment of fibres, whereby the energy required in the grinding operation will be less. Owing to the heating of the chips, even such wood species can be ground, as for instance pine and aspen, the grinding of which would not be possible otherwise. Deciduous wood produced in short cycle silviculture is also suitable as raw material. The savings of grinding energy are about 20 to 30%. The procedure is favourable in view of environment preservation, since little water is used. It is a so-called semi-dry method.

In prior art a continuously operating method for preparation of hot groundwood from wood chips is known wherein the chip flow is conducted into a pressurized steaming chamber, where the chips reside a few minutes and are heated to a temperature over 100° C, and from the steaming chamber to a sealing feeder, the rotor of which is circumferentially divided into adjacent compartments, each of which in its turn is filled through a feeding aperture with chips and empties, in another angular position of the rotor, through an exit aperture into a feeding conveyor, which carries the chips to a hot grinder, the groundwood obtained from the latter being transported off to further treatment, and in connection with the process the steam generated by the hot grinder and discharging from its throat in the direction against the chip flow is conducted away from the grinder.

It is a difficulty, encountered in the operation of the procedure of prior art, to remove the steam that is generated in such manner that the steam flow may not cause any chip feeding trouble nor any subsequent disturbances of operation, such as non-uniform loading of the grinder. It has been found that all disturbances of operation, of whatever kind they may be, impair the quality of the groundwood that is turned out. The steam discharging in the direction against the chip flow from the throat of the grinder furthermore tends to carry chips along with it into the steam disposal pipe. For the renewed separation of the chips from the steam flow a separate cyclone is required, which naturally increases the initial as well as operating costs of the apparatus.

The aim of the present invention is to eliminate the drawbacks mentioned. The procedure of the invention is characterized in that the steam is conducted through the chip feeding conveyor to the sealing feeder, where each compartment, as it is emptied of chips in its turn, fills with steam, and that the steam is removed from the sealing feeder through a steam draining aperture located, in the direction of rotation of the rotor, before the chip feeding aperture. By this procedure the steam flow will be exactly regulated and controlled. While the sealing feeder doses the chip flow, it effects at the same time the dosage of steam flow in the opposite direction so that this will be uniform.

The invention also concerns an apparatus for carrying out the procedure of the invention, comprising a pressurized steaming chamber with a sealing feeder for discharging the chips from the chamber into a feeding conveyor, which carries the chips to a hot grinder, and the rotor of said sealing feeder being circumferentially divided into mutally adjacent compartments, each of which in its turn fills through a feeding aperture with chips and empties in another angular position of the rotor through a discharge aperture. The apparatus is characterized in that the sealing feeder has a steam draining aperture located, in the direction of rotation of the rotor, before the chip feeding aperture.

The invention is described below, with reference to the attached drawing, wherein FIG. 1 presents a schematical diagram of the production of hot groundwood.

Figure 4:
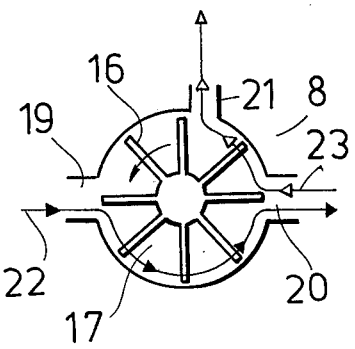

FIG. 4 perspicuously illustrates, schematically, the flow of chips and steam through the sealing feeder.

In the drawing, the reference numeral 1 indicates a screw conveyor, by the aid of which the wood chips are carried to the sealing feeder 2, which constitutes the upper end piece of the steaming chamber 3. The screw conveyor 1 is under atmospheric pressure, whereas in the chamber 3 a pressure of about 2 kg/cm² gauge prevails. The sealing feeder 2 continuously transfers chips into the chamber 3, but it does not allow any pressure to discharge therefrom. The interrupted line 4 indicates the upper surface of the chip layer. Through the pipe 5 steam, generated by the hot grinder 6, is supplied into the chamber 3. It is also possible to introduce steam through the pipe 9 from another source, and this is in fact necessary when the hot groundwood preparation process is being started up, since then the grinder 6 does not yet produce any steam. On the bottom of the chamber 3 there is a mixer means 7, which continuously feeds adequately steamed chips to the sealing feeder 8, whence the chips go to the screw conveyor 10, which feeds chips into the throat of the grinder 6. The ground pulp, that is the hot groundwood, departs through the pipe 11 towards further treatment steps.

Figure 2:
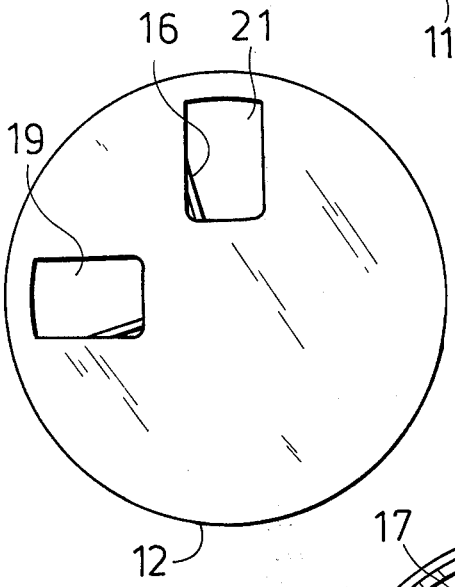
FIG. 2 shows the section along the line II—II in FIG. 1.
Figure 3:
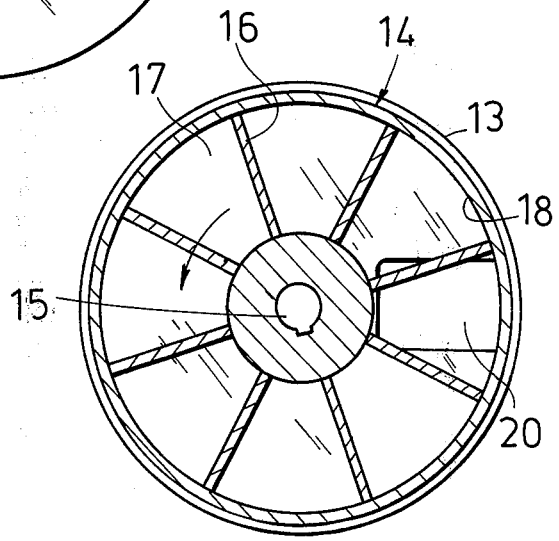
FIG. 3 shows the section along the line III—III in FIG. 1.

The design of the sealing feeder 8 is seen in FIGS. 2 and 3. It consists of the upper end plate 12 and the lower end plate 13. The end plates are stationary and between them the rotor 14 is interposed. The rotor is affixed on the shaft 15, which is rotated by a motor (not depicted). The rotor 14 consists of radial partitions 16 mutually separating a number of compartments 17, and of a continuous outer ring 18, which connects the outer ends of the partitions. The upper end plate 12 has a substantially rectangular feeding aperture 19, to which chips continuously arrive from the steaming chamber 3. The lower end plate has a similarly substantially rectangular discharge aperture 20, which opens into the screw conveyor 10.

The chip flow through the sealing feeder 8 takes place in that the chips supplied through the feeding aperture 19 in the upper end plate 12 into the compartments 17 of the rotor 14 are carried along by the rotor in its rotation through approximately a half turn and fall through the discharge aperture 20 in the lower end plate 13 into the screw conveyor 10. The end plates 12 and 13 abut tightly enough on the rotor 14 to prevent pressure leakages through the sealing feeder 8.

The hot grinder 6 continuously generates steam, which discharges through the throat of the grinder, against the chip flow, into the screw conveyor 10. This steam has to be carried off in one way or another. According to the invention this is accomplished in that the steam is conducted through the screw conveyor 10 to the sealing feeder 8. As each compartment in its turn is emptied of chips, it fills at the same time with steam through the chip discharge aperture 20. The steam is drained from the sealing feeder 8 through the steam draining aperture 21, which is located in the direction of rotation of the rotor 14, before the chip feeding aperture 19. Thereby the sealing feeder 8 operates not only as a chip dosage means but also as steam dosage means so that the steam flow takes place in a controlled manner. In FIG. 4 the chip flow 22 and steam flow 23 through the sealing feeder 8 have been schematically presented in conspicuous manner. To the steam draining aperture 21 a pipe 5 has been connected, which carries the steam to the chamber 3 for the purpose of steaming and heating the chips.

Figure 1:
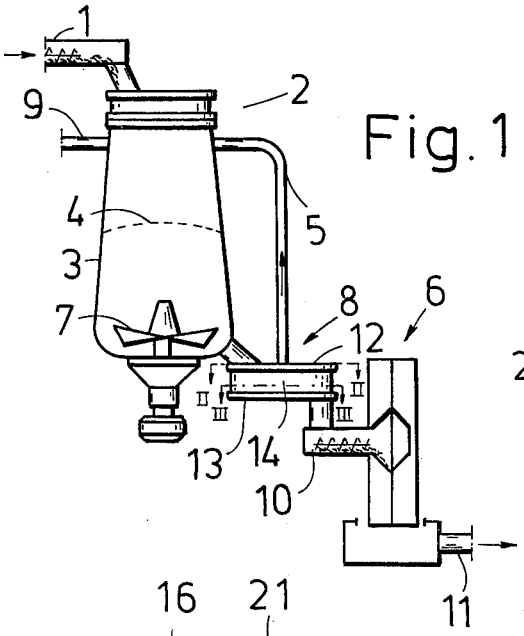

It is obvious to one skilled in the art that different embodiments of the invention may vary within the scope of the claims following below. For instance, the steam that has passed through the sealing feeder 8 need not necessarily be conducted through the pipe 5 into the steaming chamber 3: the steam may be utilized towards another purpose. The sealing feeder must not necessarily be of the kind shown in FIGS. 1 to 3, where the arriving and departing flows are axially through the apertures 19, 20 and 21 in the end plates 12 and 13. It is also possible to use a sealing feeder designed in principle as shown by FIG. 4, where the incoming and outgoing flows are radial.

I claim:

1. In a continuous process for preparing hot groundwood from wood chips wherein the chips are preheated at a temperature in a steam chamber in excess of 100° C; transporting the preheated chips through steam-preheated compartments of a sealing feeder, having a rotor, to a hot grinder by means of a feeding conveyor; the improvement which is comprised in that the steam is conducted back from the grinder through the feeding conveyor to the sealing feeder in a flow direction opposite to that of the chip flow direction, wherein each compartment is filled with steam as it is emptied of chips, draining the steam from the sealing feeder through a steam draining aperture in the direction of rotation of the rotor, located before the feeding aperture, and through a pipe into the steam chamber, in order to uniformly meter the chip feed and the steam flow.

* * * * *